US008844636B2

(12) United States Patent
Bebak et al.

(10) Patent No.: US 8,844,636 B2
(45) Date of Patent: Sep. 30, 2014

(54) HYDRAULIC ASSIST DEPLOYMENT SYSTEM FOR ARTIFICIAL LIFT SYSTEMS

(75) Inventors: Kenneth T. Bebak, Tulsa, OK (US); Steven K. Tetzlaff, Owasso, OK (US)

(73) Assignee: Baker Hughes Incorporated, Houston, TX (US)

( * ) Notice: Subject to any disclaimer, the term of this patent is extended or adjusted under 35 U.S.C. 154(b) by 252 days.

(21) Appl. No.: 13/352,580

(22) Filed: Jan. 18, 2012

(65) Prior Publication Data

US 2013/0180730 A1 Jul. 18, 2013

(51) Int. Cl.
*E21B 23/00* (2006.01)

(52) U.S. Cl.
USPC ..... 166/381; 166/68; 166/386; 175/51

(58) Field of Classification Search
CPC ..... E21B 23/00; E21B 23/04; E21B 17/003; E21B 17/028; E21B 33/047; E21B 23/08; E21B 4/18; E21B 2023/008
USPC ..... 166/381, 68, 65.1, 383, 386, 105; 175/98, 104, 51, 97
See application file for complete search history.

(56) References Cited

U.S. PATENT DOCUMENTS

| | | | | |
|---|---|---|---|---|
| 4,558,751 | A | 12/1985 | Huffaker | |
| 4,981,080 | A | 1/1991 | Elstone, III | |
| 5,269,377 | A * | 12/1993 | Martin | 166/385 |
| 5,794,703 | A | 8/1998 | Newman et al. | |
| 5,954,483 | A | 9/1999 | Tetzlaff | |
| 6,193,474 | B1 | 2/2001 | Tetzlaff | |
| 6,454,011 | B1 | 9/2002 | Schempf et al. | |
| 6,675,888 | B2 | 1/2004 | Schempf et al. | |
| 7,685,946 | B1 * | 3/2010 | Elstone, III | 104/138.2 |
| 7,770,667 | B2 | 8/2010 | Moore | |
| 2008/0314639 | A1 * | 12/2008 | Kotsonis et al. | 175/51 |
| 2009/0101345 | A1 * | 4/2009 | Moffitt et al. | 166/285 |
| 2010/0012315 | A1 | 1/2010 | McInally | |
| 2010/0206577 | A1 * | 8/2010 | Martinez | 166/369 |

FOREIGN PATENT DOCUMENTS

| | | | |
|---|---|---|---|
| WO | WO 2007140612 | A1 * | 12/2007 |
| WO | 2008102280 | A1 | 8/2008 |

* cited by examiner

*Primary Examiner* — David Andrews
*Assistant Examiner* — Taras P Bemko
(74) *Attorney, Agent, or Firm* — Bracewell & Giuliani LLP

(57) ABSTRACT

A well conveyance system couples to an uphole end of an artificial lift system and operates to push the artificial lift system through a tubing string for deployment in a wellbore. The well conveyance system includes a wellbore tractor adapted to push the artificial lift system through the tubing string and a swab cup assembly having a swab cup and a perforated nipple extending therethrough. The perforated nipple includes a nipple passage allowing for fluid flow from an area downhole from the swab cup to an area uphole from the swab cup when the wellbore tractor operates. A valve selectively blocks the perforated nipple to permit a hydraulic pressure to be applied to the tubing string uphole of the swab cup, exerting a downhole force on the swab cup to aid in deployment of the artificial lift system.

7 Claims, 4 Drawing Sheets

HYDRAULIC ASSIST DEPLOYMENT SYSTEM FOR ARTIFICIAL LIFT SYSTEMS

BACKGROUND OF THE INVENTION

1. Field of the Invention

This invention relates in general to artificial lift systems and, in particular, to an alternate deployment mechanism for artificial lift systems.

2. Brief Description of Related Art

Once an oil and gas well is drilled, producers may rely on subsurface pressure within the fluid reservoir to lift the oil and gas to the surface. The reservoir pressure is sufficient to lift the reservoir fluid the entire distance from the reservoir, through any well deviations, i.e. horizontal sections of the well, to the surface. Where reservoir pressure is insufficient to lift the fluid to the surface, an artificial lift system may be deployed to a location within the well. The artificial lift system typically includes a pump portion and a means to drive the pump to lift the hydrocarbons to the surface. Many well installations use artificial assistance, such as pumps and, in particular, electric submersible pumps (ESPs), to retrieve hydrocarbons and other fluids from subsurface locations. Typically, the pump will be lowered to a subsurface location with the assistance of a drilling or workover rig. For example, the pump may be coupled to an end of a tubing string and then the tubing string may be run into the well installation for deployment of the pump. This process takes a significant amount of time to deploy the pump and retrieve the pump if the pump becomes inoperative. In addition, the cost to rent and operate a drilling or workover rig may be prohibitively expensive for pump retrieval operations.

To overcome some of these problems, tubing strings may be run in place within the well and the pump deployed through the tubing string. A workover or drilling rig may not be needed as the deployment rig may run the pump on a wireline, removing the need of a suitable rig to support the weight of the deploying string. This allows for deployment and retrieval of the pump in shorter time frames, thus reducing the cost associated with both actions. The pump is lowered through the tubing string and landed in an electrical receptacle that receives power from an electric umbilical run with the tubing string. However, these deployment methods may be unable to deploy a pump through a horizontal well section as the methods rely primarily on gravity to move the pump downhole. Wellbore tractors may be coupled to the pump to push or pull the pump through the tubing string. In these embodiments, a workover or drilling rig is not needed as the locomotive means for the pump are placed in hole with the pump. However, these wellbore tractors may face problems when the tractor encounters a deviated portion of the well, or a portion of the well full of debris. In those situations, the wellbore tractor may not be able to move the system through the deviated portion or debris located within the tubing string.

To remove an inoperative pump a well must often be killed. These kill processes may include a kill device placed in the well and a drilling or operational fluid having a heavier specific weight than that of the production fluid that is supplied to the well during workover to remove the rotationally challenged or inoperative pump. Often the heavier fluid permeates into the formation. Once an operational pump is in place within the well, there will be a production lag as the operational fluid that permeated into the reservoir must be removed before production from the well can resume. This lag time may vary in length and represents significant loss of productive operation of the well. Therefore, there is a need for an alternative deployment apparatus that may be conveyed through tubing, that may not be stopped or limited by highly deviated sections of the tubing string or debris located within the tubing string, and that may be deployed in a live well.

SUMMARY OF THE INVENTION

These and other problems are generally solved or circumvented, and technical advantages are generally achieved, by preferred embodiments of the present invention that provide a hydraulic assist deployment system for artificial lift systems and methods for using the same.

In accordance with an embodiment of the present invention, a well deployment system for through tubing conveyance of an artificial lift system (ALS) through a tubing string is disclosed. The ALS includes a pump portion, a seal portion, a motor portion, and an electrical connection assembly mounted to a downhole end of the motor to engage a mating electrical connection assembly deployed at a downhole end of the tubing string. The electrical connection assembly supplies electrical power to the motor for operation of the ALS. The well deployment system and the ALS are disposed in the tubing string. The well deployment system includes a wellbore tractor coupled to the ALS opposite the electrical connection assembly. The wellbore tractor is adapted to push the ALS through the tubing string to convey the ALS through a non-vertical section of the tubing string. The well deployment system also includes a swab cup type element positioned between the wellbore tractor and the pump portion of the ALS. The swab cup is adapted to selectively receive a hydraulic pressure to assist the wellbore tractor in conveying the ALS through the non-vertical section of the tubing string. A perforated nipple is coupled to the wellbore tractor between the swab cup and the wellbore tractor to provide a fluid channel through the swab cup so that the swab cup does not hinder conveyance of the ALS when the wellbore tractor operates unassisted. A valve is positioned in the fluid channel of the perforated nipple. The valve has an open position permitting fluid flow through the perforated nipple channel and a closed position preventing fluid flow through the perforated nipple channel, thereby selecting hydraulic assistance. A power umbilical extends from the surface to the wellbore tractor and the valve. The power umbilical provides power for operation of the wellbore tractor and the valve.

In accordance with another embodiment of the present invention, a well deployment system for through tubing conveyance of an electric submersible pump (ESP) through a tubing string is disclosed. The ESP includes a pump portion, a seal portion, a motor portion, and an electrical connection assembly mounted to a downhole end of the motor to engage a mating electrical connection assembly deployed at a downhole end of the tubing string for supplying electrical power to the motor for operation of the ESP. The well deployment system and the ESP are disposed in the tubing string. The well deployment system includes an electric wellbore tractor coupled to the ESP opposite the electrical connection assembly. The wellbore tractor is adapted to push the ESP through the tubing string to convey the ESP through a non-vertical tubing string section. A swab cup is positioned between the wellbore tractor and the pump portion of the ESP. The swab cup is adapted to selectively receive a hydraulic pressure to assist the wellbore tractor in conveying the ESP through the non-vertical tubing string section. A perforated nipple is coupled to the wellbore tractor between the swab cup and the wellbore tractor. The perforated nipple has a tubular body defining a nipple passage, an outer diameter smaller than the inner diameter of the tubing string, and a plurality of openings extending from an exterior of the tubular body through a wall of the tubular body to the nipple passage for flow of fluid therethrough. The tubular body is coupled to the wellbore tractor at an uphole end of the tubular body and an electric valve at a downhole end of the tubular body. The tubular body passes through the swab cup, allowing fluid to pass from an area below the swab cup through the nipple passage, and through the openings for passage through the swab cup to prevent a buildup of pressure downhole from the swab cup. The electric valve is positioned in the fluid channel of the perforated nipple. The valve has an open position permitting fluid flow through the perforated nipple channel and a closed position preventing fluid flow through the perforated nipple channel, thereby selecting hydraulic assistance. A power umbilical extends from the surface to the wellbore tractor and the valve, the power umbilical providing electric power for operation of the wellbore tractor and the valve.

In accordance with yet another embodiment of the present invention, a method for deploying an electric submersible pump (ESP) through a non-vertical portion of a tubing string is disclosed. The ESP includes a pump portion, a seal section, a motor portion, and an electrical connection assembly mounted to an end of the ESP for connection with a mating electrical connection assembly disposed on a downhole end of the tubing string. The method provides a wellbore tractor having a swab cup assembly on a downhole end of the tractor, and couples the wellbore tractor to an uphole end of the ESP so that the swab cup assembly is interposed between the wellbore tractor and the ESP. The method runs the coupled ESP and the wellbore tractor assembly into a tubing string, and in the event a non-vertical portion of the tubing string is reached, the method operates the wellbore tractor to push the ESP through the non-vertical portion of the tubing string. In the event additional assistance is needed to move the ESP through the non-vertical portion of the tubing string, the method actuates the swab cup assembly to seal the ESP to the tubing string and supplies hydraulic pressure to the tubing string to hydraulically assist the wellbore tractor.

An advantage of the disclosed embodiments is that they provide a hydraulic assist deployment system allowing an artificial lift system to be placed in or beyond a horizontal portion of a well. In addition, the disclosed embodiments provide a hydraulic assist deployment system that may operate with hydraulic assist to overcome blockages or debris within a tubing string through which the artificial lift system is deployed. Still further, the disclosed embodiments provide a hydraulic assist deployment system that may wipe or clean the tubing string during deployment of the artificial lift system and retrieval of the deployment system and artificial lift system. In yet another advantage, the hydraulic assist deployment system may be left in place following deployment of the artificial lift system and may operate to retrieve an inoperative artificial lift system without additional equipment. Additionally, embodiments disclosed herein provide an apparatus that can deploy the artificial lift system in a live well.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments. The terms uphole and downhole will be used to denote positions within a wellbore. Uphole refers to those locations closer to a wellhead of the wellbore and downhole refers to those locations closer to a terminus of the wellbore In the following discussion, numerous specific details are set forth to provide a thorough understanding of the present invention. However, it will be obvious to those skilled in the art that the present invention may be practiced without such specific details. Additionally, for the most part, details concerning operation, construction, and the like of an artificial lift system, such as an electric submersible pump system, have been omitted inasmuch as such details are not considered necessary to obtain a complete understanding of the present invention, and are considered to be within the skills of persons skilled in the relevant art.

Figure 1:
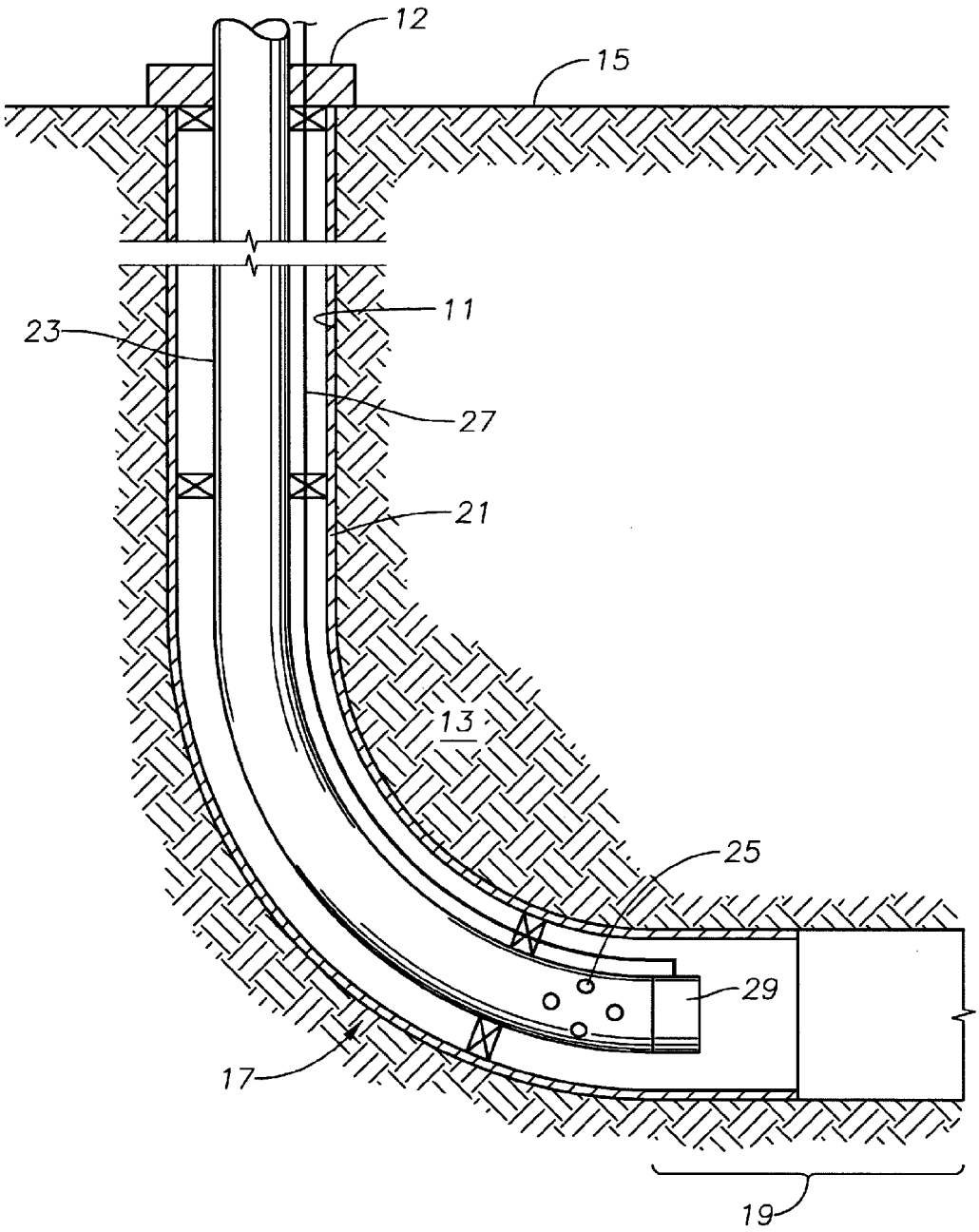
FIG. 1 is a schematic view of a partially cased wellbore having at least one horizontal section and a tubing string deployed therein in accordance with an embodiment of the present invention.

FIG. 1 illustrates a wellbore 11 drilled into a formation 13. Wellbore 11 extends from a wellhead 12 located at a surface 15 to a heel 17 of wellbore 11 at some distance below surface 15 and then to a toe (not shown). Heel 17 is an entry of a substantially horizontal section 19 of wellbore 11. Wellbore 11 may terminate at horizontal section 19 or may extend further and subsequently turn downward for continued vertical drilling. Wellbore 11 may be lined or cased with casing 21 or may be an open hole wellbore 11 as shown extending through horizontal section 19. A tubing string 23 extends into wellbore 11 and terminates proximate to horizontal section 19 so that fluid within horizontal section 19 may flow into a lower end of tubing string 19 through perforations or tubing string openings 25. An electric umbilical 27 may be run with tubing string 23 and terminate at an electrical connection shoe 29. Electrical connection shoe 29 is a reception assembly adapted to receive a mating electrical assembly coupled to a pump motor (not shown) to transmit electric power from the surface to the pump motor. In an embodiment, electrical connection shoe 29 is open so that well fluid may enter tubing string 23 through electrical connection shoe 29 and tubing string openings 25. In another embodiment, electrical connection shoe 29 is not open and well fluid enters tubing string 23 through tubing string openings 25 and not electrical connection shoe 29.

Figure 2:
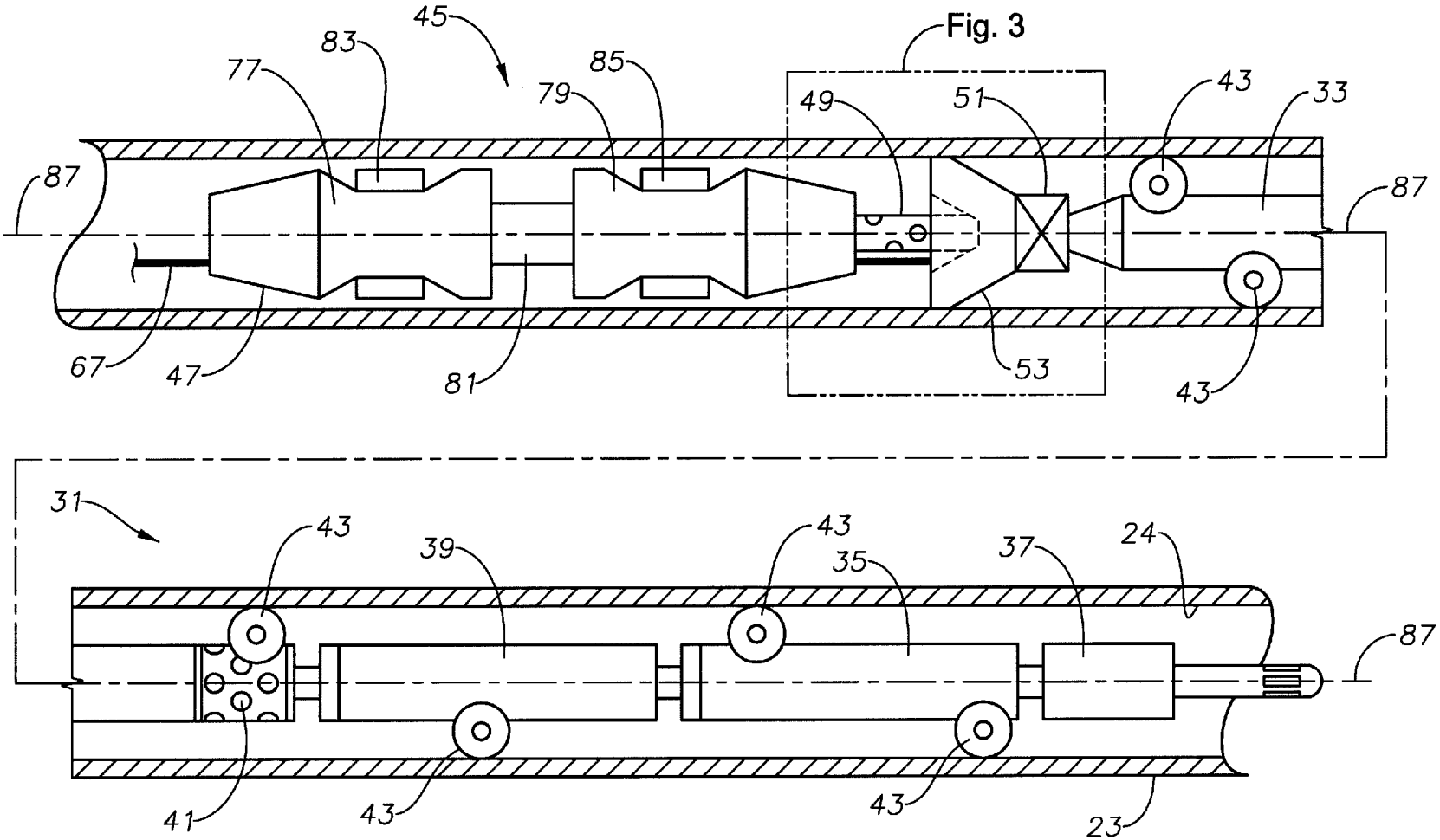
FIG. 2 is a partial sectional view of a portion of the tubing string of FIG. 1 with an electric submersible pump assembly and well conveyance system deployed therein in accordance with an embodiment of the present invention.

Tubing string 23 has an inner diameter 24 as shown in FIG. 2. An artificial lift system, such as an electrical submersible pump assembly (ESP) 31, will be conveyed through tubing string 23 for deployment at horizontal section 19. A person skilled in the art will understand that ESP 31 is an exemplary artificial lift system; any suitable artificial lift system may be used with the deployment system disclosed herein. ESP 31 includes a pump portion 33, driven by a motor 35. An electrical connection assembly 37 mounts to a downhole end of motor 35 and is adapted to mate with electrical connection shoe 29 (FIG. 1) to receive electric power from electric umbilical 27 (FIG. 1) and transmit electric power to motor 35 for operation of motor 35. Motor 35 is an electric motor adapted to rotate a shaft or plurality of coupled shafts extending from motor 35 through a seal section 39 to pump portion 33. Rotation of the shaft will cause rotation of a plurality of impellers interspaced between static diffusers and disposed within pump portion 33, pressurizing wellbore fluid to lift the fluid through tubing string 23 to surface 15. Pump portion 33 includes pump inlets 41 located proximate to a downhole end of pump portion 33, allowing wellbore fluid to move from an interior of tubing string 23 into pump portion 33 for pressurization and lifting of the wellbore fluid. Seal section 39 equalizes the internal pressure of the lubricant within motor 35 to that of the wellbore, preventing catastrophic failure of motor 35. A person skilled in the art will recognize that ESP 31 may include multiple seal sections, gas separators, flow inducers, and the like.

ESP 31 may be positioned on a plurality of wellbore skates 43. Wellbore skates 43 center ESP 31 within tubing string 23 and support ESP 31 spaced-apart from inner diameter 24 of tubing string 23 when ESP 31 enters horizontal portion 19 (FIG. 1) of the wellbore 11 (FIG. 1). Wellbore skates 43 will engage both an outer surface of ESP 31 and inner diameter 24. In an embodiment, wellbore skates 43 are free-wheeling so that wellbore skates 43 may be coupled to ESP 31 and be adapted to roll along inner diameter 24, aiding in conveyance of ESP 31. In other embodiments, wellbore skates 43 are coupled to ESP 31 and are stationary components adapted to slide against inner diameter 24 of tubing string 23. In still another embodiment, wellbore skates 43 may be driven electric motors, providing additional assistance to the conveyance of ESP 31 through tubing string 23.

Figure 3:
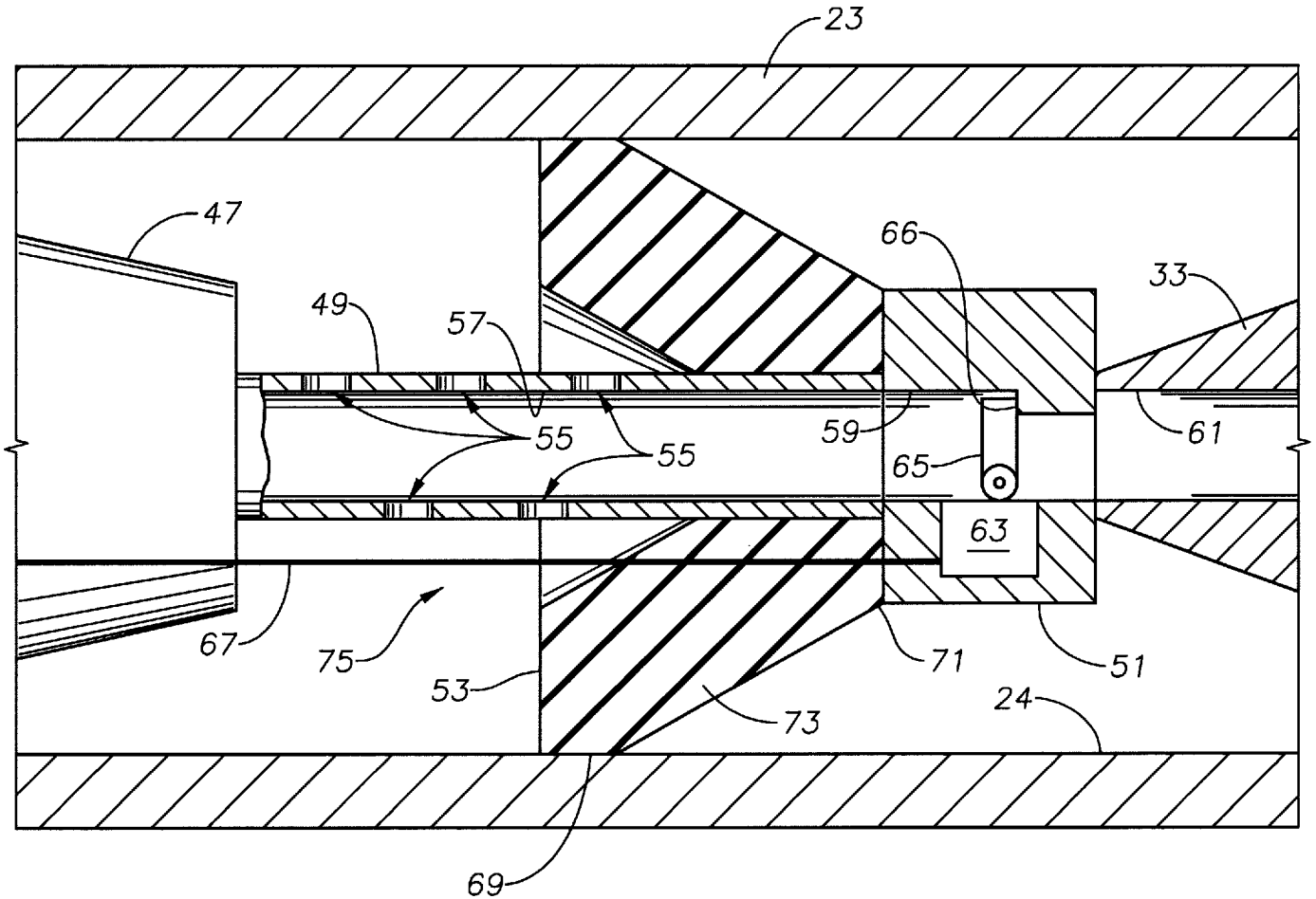
FIG. 3 is a detailed sectional view of a portion of the well conveyance system of FIG. 2 in accordance with an embodiment of the present invention.

A conveyance assembly 45 couples to an uphole end of ESP 31. In the illustrated embodiment, conveyance assembly 45 includes a push-pull tractor 47, a perforated nipple 49, an electric valve 51, and a swab cup 53. Perforated nipple 49 has an uphole end coupled to a downhole end of push-pull tractor 47 and a downhole end that penetrates swab cup 53 to couple to electric valve 51, as shown in FIG. 3. Perforated nipple 49 includes a plurality of openings 55 extending through a tubular wall of perforated nipple 49. Openings 55 provide a fluid path from tubing string 23 into a nipple passage 57. Nipple passage 57 extends a length of perforated nipple 51 and joins a central passage 59 of electric valve 51. Central passage 59 provides a fluid path through electric valve 51 into a pump bore 61 of pump portion 33. Fluid may flow from pump bore 61 through electric valve central passage 59 and into nipple passage 57, where fluid may then flow through openings 55 into tubing string 23 uphole from swab cup 53. In other embodiments, electric valve 51 may include a bypass passage, permitting fluid to bypass bore passage 61 and flow directly from tubing string 23 downhole from swab cup 53 to tubing string 23 uphole from swab cup 53.

Electric valve 51 may be any suitable valve type adapted to operate and selectively permit fluid to pass through central passage 59 of electric valve 51. In the illustrated embodiment of FIG. 3, electric valve 51 includes an electric actuator 63 coupled to a flapper 65. A person skilled in the art will understand that electric valve 51 may comprise any suitable valve assembly adapted to selectively open and close central passage 59. For example, in another embodiment, electric valve 51 may be a ball valve. An electric umbilical 67 connects to electric actuator 63 to provide electric power to electric actuator 63. Electric actuator moves flapper 65 from the position shown in FIG. 3, where flapper 65 is landed on a valve seat 66 to prevent flow of fluid through central passage 59 to a position permitting fluid flow through central passage 59. In the illustrated embodiment, flapper 65 may be pushed open by fluid pressure from below so that in the event electric valve 51 fails, wellbore fluid may still be pumped uphole through central passage 59 and lifted to surface 15 (FIG. 1). A person skilled in the art will recognize that electric umbilical 67 may also carry a control signal for operation of electric valve 51. In embodiments that include a bypass passage through electric valve 51, electric valve 51 may operate flapper 65 to selectively permit flow through both the bypass passage of electric valve 51 and central passage 59.

Swab cup 53 may be a packer cup adapted to receive a fluid pressure through tubing string 23. A person skilled in the art will understand that as used herein, swab cup 53 may be any suitable swab cup type element adapted to receive hydraulic pressure supplied to a tubing string as described in more detail below. In the illustrated embodiment, swab cup 53 is a frusto-conical member having a larger diameter portion 69 extending uphole toward push-pull tractor 47. In the illustrated embodiment, larger diameter portion 69 will seal to inner diameter 24 so that fluid may not move downhole across swab cup 53 between larger diameter portion 69 and inner diameter 24. Swab cup 53 has a smaller diameter portion 71 coupled and sealed to electric valve 51. A conical wall 73 extends between larger diameter portion 69 and smaller diameter portion 71 to define a cavity 75 opening uphole toward push-pull tractor 47. Electric umbilical 67 penetrates and seals to swab cup 53 for connection to electric actuator 63.

Push-pull tractor 47 of FIG. 2 is a wellbore tractor adapted to push ESP 31 through horizontal portion 19 of tubing string 23. Push-pull tractor 47 has an uphole portion 77, a downhole portion 79, and a hydraulic piston assembly 81 disposed between and coupled to uphole portion 77 and downhole portion 79. Uphole portion 77 includes a gripping means 83 coupled to uphole portion 77 and adapted to selectively engage inner diameter 24 to anchor uphole portion 77 to tubing string 23. In an embodiment, gripping means 83 includes actuable feet configured to be pushed radially into inner diameter 24. The feet may be moved by a hydraulic assembly, electric assembly, or some combination thereof. Downhole portion 79 includes a gripping means 85 coupled to downhole portion 79 and adapted to selectively engage inner diameter 24 to anchor downhole portion 79 to tubing string 23. In an embodiment, gripping means 85 includes actuable feet configured to be pushed radially into inner diameter 24. The feet may be moved by a hydraulic assembly, electric assembly, or some combination thereof. Hydraulic piston assembly 81 comprises at least one hydraulic piston adapted to operate along an axis 87 of tubing string 23. Push-pull tractor 47 will include an electric motor and hydraulic/electric controllers adapted to selectively operate the uphole gripping means 83, the downhole gripping means 85, and the hydraulic piston 81. Push-pull tractor 47 receives electric power and communication signals through electric umbilical 67 run with well conveyance system 45 through tubing string 23. A person skilled in the art will recognize that electric umbilical 67 may provide power to both push-pull tractor 47 and electric valve 51, and, in alternative embodiments, electric umbilical 67 may comprise more than one electric umbilical.

In an operative embodiment, well conveyance system 45 is coupled to ESP 31 and placed within tubing string 23. A platform, rig, wireline truck, or other suitable surface vehicle is used to lower well conveyance system 45 and ESP 31 through tubing string 23. When well conveyance system 45 and ESP 31 reach horizontal portion 19, operative signals may be transmitted to push-pull tractor 47 through electric umbilical 67 instructing push-pull tractor 47 to operate. Push-pull tractor 47 will then operate in the following manner. The controllers and motor of push-pull tractor 47 will operate to actuate uphole gripping means 83 to push the feet into inner diameter 24, anchoring uphole portion 77 to tubing string 23. The controllers and motor of push-pull tractor 47 then operate piston assembly 81. Piston assembly 81 will act against uphole portion 77 to push downhole portion 79, and consequently ESP 31, through tubing string 23. When piston assembly 81 reaches its full stroke, the controllers and motor of push-pull tractor 47 then operate to actuate downhole gripping means 85 to push the feet into inner diameter 24, anchoring downhole portion 79 to tubing string 23. The motors and controllers of push-pull tractor 47 then operate to actuate uphole gripping means 83 to pull the feet toward uphole portion 77, releasing uphole gripping means 83 from inner diameter 24 of tubing string 23. The motors and controllers of push-pull tractor 47 again operate piston assembly 81. Piston assembly 81 will act against downhole portion 79 to pull uphole portion 77 downhole toward downhole portion 79, resetting push-pull tractor 47. The motor and controllers of push-pull tractor 47 then repeat the process to continue moving well conveyance assembly 45 and ESP 31 through tubing string 23.

In the event push-pull tractor 47 binds, is blocked by debris, blocked due to well deviation, or is unable to push ESP 31 through tubing string 23, hydraulic assistance may be deployed to provide additional force in a downhole direction for push-pull tractor 47. Under normal conditions, electric valve 51 will be in an open position so that fluid may flow through pump portion 33, electric valve 51 and perforated nipple 49, around swab cup 53. For hydraulic assistance, electric valve 51 will be actuated to close flapper 65 against valve seat 66 within electric valve 51, blocking passage of fluid downhole through perforated nipple 49 and electric valve 51 as shown in FIG. 3. Hydraulic fluid pressure may then be applied to the interior of tubing string 23 from the surface. Cavity 75 will receive the hydraulic fluid pressure and, due to the seal formed by larger diameter portion 69 of swab cup 53 and the blockage of nipple passage 57 and central passage 59, exert a downhole force on swab cup 53, moving well conveyance system 45 and ESP 31 further downhole to a portion where push-pull tractor 47 may again operate without the need for assistance.

As well conveyance system 45 is moved through tubing string 23, the seal formed between the larger diameter portion 69 of swab cup 53 may wipe, clean, or swab inner diameter 24.

Once ESP 31 lands in electrical connection shoe 29 (FIG. 1), and an electrical connection is established between motor 35 and power umbilical 27, well conveyance system 45 may be released from ESP 31 and retrieved from tubing string 23. In an embodiment, an electrically actuable latch assembly couples well conveyance system 45 to ESP 31. The electrically actuable latch assembly may be actuated through a signal through electric umbilical 67 to release well conveyance system 45 from ESP 31; well conveyance system 45, including wellbore tractor 47, perforated nipple 49, valve 51, and swab cup 53, may be pulled by wireline from tubing string 23. Alternatively, wellbore tractor 47 may be operated in reverse to move well conveyance system 45 uphole and out of tubing string 23.

In another embodiment, well conveyance system 45 may be left in place for subsequent retrieval of ESP 31. Wellbore fluids will be lifted to the surface through perforated nipple 49. When well conveyance system 45 is left in place, electric valve 51 will be actuated so that electric actuator 63 will maintain flapper 65 in the open position to allow fluid flow through central passage 59. Motor 35 will receive electric power through power umbilical 27, electrical connection shoe 29, and electrical connection assembly 37. Motor 35 may then operate to rotate a shaft or plurality of coupled shafts extending from motor 35 through seal assembly 39 to pump portion 33. There impellers will be rotated within diffusers to pressurize wellbore fluids and lift the fluids through pump bore 61, through the open electric valve 51 central passage 59, through nipple passage 57, and out nipple openings 55. There the fluid is lifted through tubing string 23 to the surface. A person skilled in the art will understand that these embodiments include additional components necessary to dispose and operate ESP 31 in tubing string 23. These components are contemplated and included in the disclosed embodiments.

Figure 4:
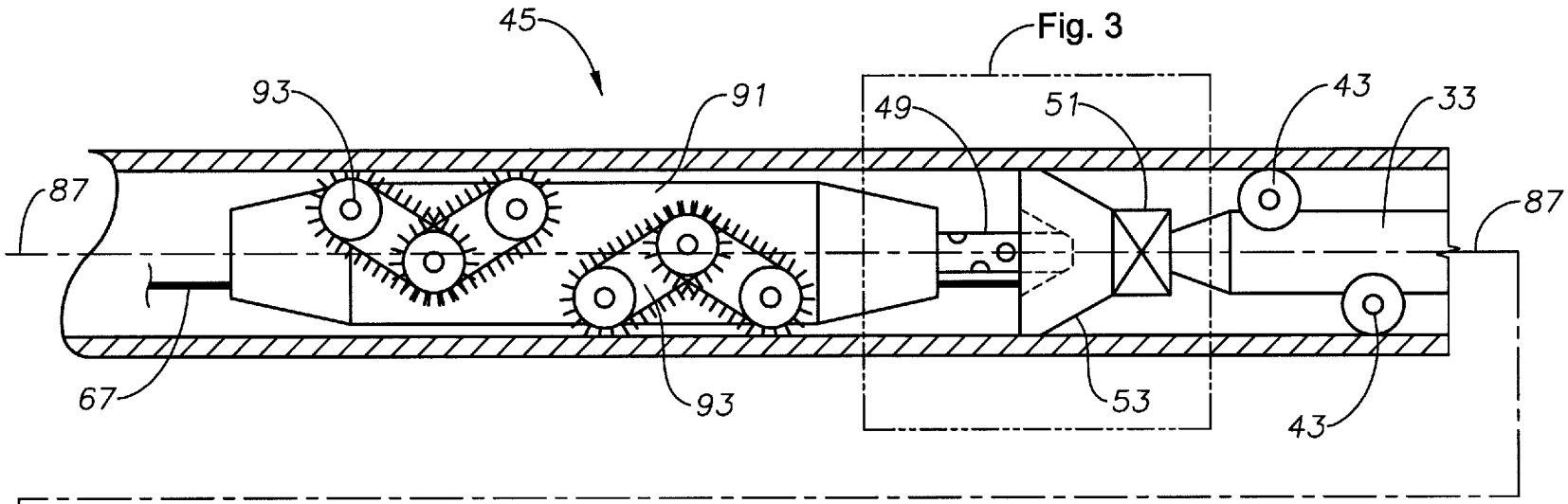
FIG. 4 is a partial sectional view of the portion of the tubing string of FIG. 1 with the electric submersible pump assembly and an alternative well conveyance system deployed therein in accordance with an embodiment of the present invention.
Figure 4:
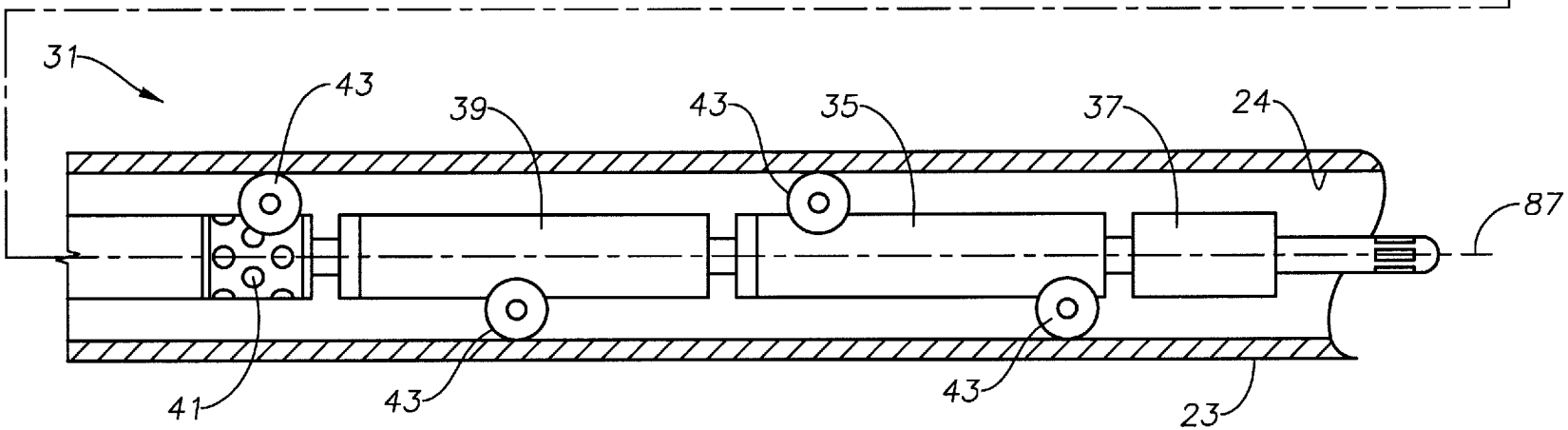

In the alternate embodiment illustrated in FIG. 4, hydraulic push-pull tractor 47 is replaced with an electric tractor 91. Electric tractor 91 includes one or more rotatable treads 93 adapted to engage inner diameter 24 of tubing string 23. Electric tractor 91 will include an electric motor mechanically coupled to the rotatable treads 93 and adapted to rotate rotatable treads 93. Similar to push-pull tractor 47, electric tractor 91 will receive electric power and operative control signals through electric umbilical 67. Following deployment into tubing string 23, electric tractor 91 will be activated when well conveyance system 45 reaches horizontal portion 19 of wellbore 11. The motors of electric tractor 91 will operate to rotate treads 93, propelling electric tractor 91 through tubing string 23. Electric tractor 91 may receive hydraulic assistance through operation of electric valve 51 and swab cup 53 in the same manner as push-pull tractor 47 described above with respect to FIG. 2 and FIG. 3.

Accordingly, the disclosed embodiments provide numerous advantages. For example, the disclosed embodiments provide a hydraulic assist deployment system allowing an artificial lift system to be placed in or beyond a horizontal portion of a well. In addition, the disclosed embodiments provide a hydraulic assist deployment system that may operate with hydraulic assist to overcome blockages or debris within a tubing string through which the artificial lift system is deployed. Still further, the disclosed embodiments provide a hydraulic assist deployment system that may wipe or clean the tubing string during deployment of the artificial lift system and retrieval of the deployment system and artificial lift system. In yet another advantage, the hydraulic assist deployment system may be left in place following deployment of the artificial lift system and may operate to retrieve a rotationally challenged or otherwise inoperative artificial lift system without additional equipment. Additionally, embodiments disclosed herein provide an apparatus that can deploy the artificial lift system in a live well.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A well deployment system for conveyance of an artificial lift system (ALS) within a horizontal section of a well production string supported at a wellhead, the ALS includes a pump portion and a motor portion, the well deployment system comprising:

a wellbore tractor connected to a power umbilical extending through the production string and the wellhead to supply power to the tractor, the wellbore tractor being coupled to the ALS to push the ALS through the production string, the wellbore tractor and the ALS defining a downhole assembly;

a swab cup mounted to the downhole assembly and in sliding engagement with the production string, the swab cup adapted to selectively receive a hydraulic fluid pressure applied to the interior of the production string at the wellhead to assist the wellbore tractor in conveying the ALS through the production string; a valve positioned in the downhole assembly, the valve having an open position permitting uphole fluid flow in the production string past the swab cup and a closed position preventing downhole fluid flow in the production string past the swab cup to enable hydraulic fluid pressure to be applied from the wellhead to the swab cup;

wherein the valve is connected with the power umbilical for moving the valve between the open and closed positions; and a perforated nipple coupled to the wellbore tractor between the swab cup and the wellbore tractor, the perforated nipple having a perforation uphole from the valve to provide an uphole flowing fluid channel through the swab cup while the valve is in the open position during conveyance of the ALS.

2. The well deployment system of claim 1, wherein the valve is positioned in the fluid channel of the perforated nipple.

3. The well deployment system of claim 1, wherein the swab cup comprises:

an elastomeric member having a conical profile, mounted around a downhole end of the perforated nipple, a smaller diameter portion of the conical profile circumscribing the outer diameter of the perforated nipple;

a larger diameter portion of the conical profile seals to the inner diameter of the production string, preventing flow of wellbore fluid from uphole of the elastomeric member between the elastomeric member and the inner diameter of the production string;

the perforated nipple passes through the elastomeric member to provide a nipple passage across the elastomeric member; and application of hydraulic pressure to the interior of the production string from uphole of the elastomeric member applies a hydraulic fluid pressure to the conical profile and exerts a downhole force on the downhole assembly when the valve closes the nipple passage.

4. The well deployment system of claim 1, wherein the power umbilical comprises an electrical conductor for providing electrical power for operation of the wellbore tractor and the valve.

5. The well deployment system of claim 1, wherein the wellbore tractor comprises a push-pull tractor including:

an uphole gripping means mounted to an uphole end of the push-pull tractor and adapted to move radially to selectively engage an inner diameter of the production string to anchor the uphole end of the push-pull tractor;

a downhole gripping means mounted to a downhole end of the tractor and adapted to move radially to selectively engage the inner diameter of the production string to anchor the downhole end of the push-pull tractor; and a piston extending between the uphole end of the push-pull tractor and the downhole end of the push-pull tractor, the piston actuable to selectively push the uphole and downhole ends apart and pull the uphole and downhole ends together.

6. The well deployment system of claim 1, wherein the wellbore tractor comprises:

a tractor body having a plurality of rotatable treads mounted to an exterior of the tractor body so that the treads engage the inner diameter of the production string.

7. A well deployment system for through tubing conveyance of an artificial lift system (ALS) through a tubing string, the ALS includes a pump portion and a motor portion, the well deployment system comprising:

a wellbore tractor coupled to the ALS to push the ALS through the tubing string, the wellbore tractor and the ALS defining a downhole assembly;

a swab cup mounted to the downhole assembly and in sliding engagement with the tubing string, the swab cup adapted to selectively receive a hydraulic fluid pressure applied to the interior of the tubing string from uphole of the swab cup to assist the wellbore tractor in conveying the ALS through the tubing string;

a valve positioned in the downhole assembly, the valve having an open position permitting fluid flow uphole past the swab cup and a closed position preventing fluid flow past the swab cup to enable hydraulic fluid pressure to be applied to the swab cup;

a perforated nipple coupled to the wellbore tractor between the swab cup and the wellbore tractor to provide an uphole flowing fluid channel through the swab cup during conveyance of the ALS; wherein the perforated nipple comprises:

a tubular body defining a nipple passage, the tubular body having an outer diameter smaller than the inner diameter of the tubing string;

a plurality of openings formed in a wall of the tubular body, the openings extending from an exterior of the tubular body to the nipple passage for flow of fluid therethrough;

the tubular body coupled to the wellbore tractor at an uphole end of the tubular body and the valve at a downhole end of the tubular body, the tubular body passing through the swab cup; and wherein fluid passes from an area downhole of the swab cup through the nipple passage, through the openings, and into an area of the tubing string above the swab cup for passage through the swab cup to prevent a buildup of pressure downhole from the swab cup.

* * * * *